US008434955B2

(12) United States Patent
Rauschert et al.

(10) Patent No.: US 8,434,955 B2
(45) Date of Patent: May 7, 2013

(54) COSMETIC UNIT

(75) Inventors: Jochen Rauschert, Coburg (DE); Karl Hartstock, Jersey City, NJ (US)

(73) Assignee: Geka GmbH, Bechhofen (DE)

( * ) Notice: Subject to any disclaimer, the term of this patent is extended or adjusted under 35 U.S.C. 154(b) by 581 days.

(21) Appl. No.: 12/675,507

(22) PCT Filed: Sep. 29, 2008

(86) PCT No.: PCT/EP2008/008259

§ 371 (c)(1),
(2), (4) Date: Feb. 26, 2010

(87) PCT Pub. No.: WO2009/043566

PCT Pub. Date: Apr. 9, 2009

(65) Prior Publication Data

US 2010/0209174 A1 Aug. 19, 2010

(30) Foreign Application Priority Data

Sep. 29, 2007 (EP) ..... 07019220

(51) Int. Cl.
*B43K 27/02* (2006.01)

(52) U.S. Cl.
USPC ..... 401/18; 401/17

(58) Field of Classification Search ..... 401/16–18, 401/126, 131; 220/23.83, 23.86, 380; 215/10; 206/229, 385; 132/317
See application file for complete search history.

(56) References Cited

U.S. PATENT DOCUMENTS

| | | | | |
|---|---|---|---|---|
| 2,863,685 | A * | 12/1958 | Boyce | 403/27 |
| 3,690,777 | A | 9/1972 | Costa | |
| 5,316,159 | A | 5/1994 | Douglas et al. | |
| 5,509,742 | A | 4/1996 | Balzarini | |
| 6,276,853 | B1 | 8/2001 | Breidenbach et al. | |
| 6,363,678 | B1 | 4/2002 | Shuler | |
| 6,682,242 | B1 | 1/2004 | Montoli | |
| 6,702,494 | B2 | 3/2004 | Dumler et al. | |
| 7,287,923 | B1 * | 10/2007 | Chen | 401/18 |
| 7,473,045 | B2 | 1/2009 | Dumler | |
| 2002/0018688 | A1 | 2/2002 | Dumler et al. | |

FOREIGN PATENT DOCUMENTS

| | | | |
|---|---|---|---|
| DE | 19733290 | A1 | 2/1999 |
| DE | 10039490 | A1 | 2/2002 |
| DE | 10213643 | A1 | 10/2003 |
| EP | 1810593 | A1 | 7/2007 |

* cited by examiner

*Primary Examiner* — David Walczak
(74) *Attorney, Agent, or Firm* — Browdy and Neimark, PLLC

(57) ABSTRACT

In the case of a cosmetic unit, including a container for holding a cosmetic, a closure cap for the container, and an applicator, which is arranged on the closure cap and is intended for applying the cosmetic, wherein two such cosmetic units can be connected to each other via a coupling device, the cosmetic unit has a coupling device which is formed on the closure cap and is intended for connection to a second cosmetic unit having a corresponding coupling device, wherein the coupling device has a coupling recess which extends perpendicularly to the central longitudinal axis of the cosmetic unit and the inner wall of which forms at least one undercut, and a coupling projection which is of complementary design to the coupling recess in such a manner that the coupling projection of a first cosmetic unit can be pushed, by a pushing movement of the cosmetic units which are to be connected, into the coupling recess of the second cosmetic unit and, in the pushed-in state, is held there in an interlocking manner.

9 Claims, 6 Drawing Sheets

COSMETIC UNIT

Figure 1:
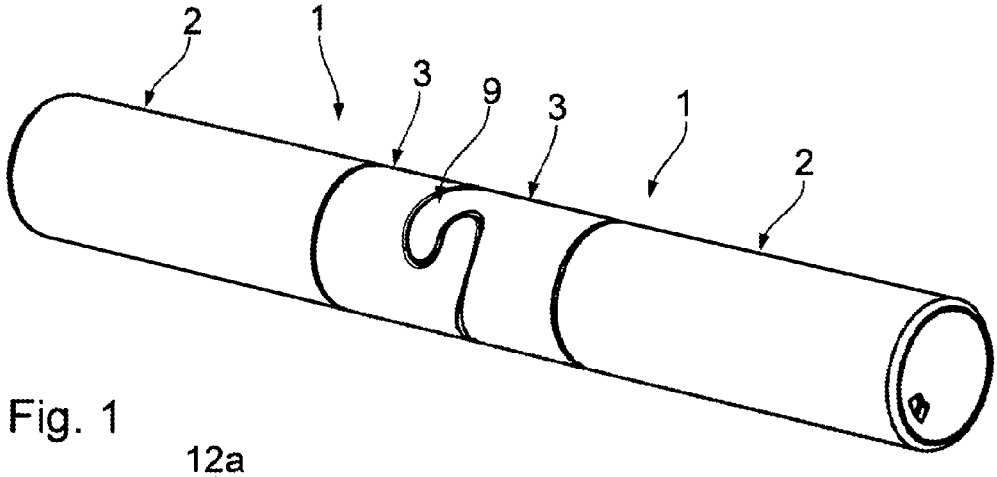

The invention relates to a cosmetics unit comprising a container for receiving a cosmetic, a closure cap for the container, and an applicator, which is disposed on the closure cap, for applying the cosmetic, wherein two such cosmetics units can be connected with each other via a coupling device.

A generic cosmetics unit is known, for example, from EP 1 810 593 A1, with the coupling device in this case being formed by a separate coupling sleeve into which the two cosmetics units to be connected can be pushed from opposite directions. Other such cosmetics units are described in DE 102 13 643 A1, DE 100 39 490 A1, DE 197 33 290 A1, U.S. Pat. No. 5,509,742 B1 and U.S. Pat. No. 3,690,777.

Furthermore, U.S. Pat. No. 5,316,159 describes a cosmetics unit which comprises, at the long side of the container, a coupling mechanism by means of which it can be connected with a second similar cosmetics unit so as to form a double cosmetics unit.

The fundamental advantage of two units combined in this way lies in the fact that different formulations and applicators can be merged and transported as a unit. A fundamental drawback of such known units lies in the fact that the are already on offer and sold as a combined unit, so that the user does not have the option of buying and combining the individual units and their contents according to her own taste and preferences. This results in the problem that, if the content of a unit has been used up prematurely, the unit cannot be purchased again separately. Finally, the coupling device is formed by a separate part, which means an additional effort in production and handling.

Set against this background, the invention is based upon the object of providing a cosmetics unit that can be separately and individually selected, bought and connected with corresponding cosmetics unit also selected separately. At the same time, the complete package comprising two cosmetics units is supposed to have an attractive appearance both in the connected as well as in the uncoupled state. Establishing the connection is supposed to be possible for the consumer himself in a simple manner, and the connection is to be axially and torsionally secured.

According to the invention, this object is achieved by the cosmetics unit comprising a coupling device formed at the closure cap for connection with a second cosmetics unit comprising a corresponding coupling device. The coupling device has a coupling recess extending perpendicularly to the central longitudinal axis of the cosmetics unit, and a coupling projection. An inner wall of the coupling recess spans, relative to an insertion direction oriented perpendicularly to the central longitudinal axis, a circumferential angle range of more than 180° and thus forms at least one undercut. The coupling projection is formed to be complementary to the coupling recess, so that the coupling projection of a first cosmetics unit can be pushed into the coupling recess of the second cosmetics unit by means of a pushing motion in the insertion direction of the cosmetics units to be connected, and that it is received therein in a positive fit in the pushed-in state.

This embodiment avoids a separate coupling device in the form of a sleeve, can be handled simply and by the consumer herself, is rugged in the coupled state can nevertheless be easily detached, and has an attractive appearance both in the coupled as well as uncoupled state.

In this case, it is an advantage for the producer that the various cosmetic formulations can each be bottled and sold individually, whereby bottling, logistics and storage can be significantly simplified and costs can be saved.

In a further embodiment of the invention, it can be provided that the coupling recess and the coupling projection are formed in a rounded-off manner, or alternatively, that the coupling recess and the coupling projection have flat outer walls which merge into each other via edges.

In order to save material and to accelerate the injection-molding process, the coupling projection can be formed to be at least partially hollow, whereby its appearance can also be made distinctive in an advantageous manner.

It is particularly beneficial to form the coupling device on the closure cap on which the applicator and the stem are also attached, so that, when the closure cap is screwed off the first unit, the closure cap and the second unit coupled thereto serve as a sort of handle.

Another embodiment provides that the coupling device is disposed on a push-on sleeve that can be slipped over the closure cap. Longitudinal grooves can be provided on the outside of the closure cap and on the inside of the push-on sleeve in order to establish a non-rotatable connection, and latching projections and recesses, respectively, can be provided for axial fixing on the outside of the closure cap and on the inside of the push-on sleeve.

The coupling device itself can comprise a latching projection or a latching recess, respectively, on an outer surface of the coupling projection and on an inside of the coupling recess, so that the coupled state is fixed thereby.

In an advantageous embodiment, the coupling projection can protrude radially outwardly over the jacket surface of the cosmetics unit, so that a central ball-like portion is formed by two coupling devices connected with each other, which gives the combined cosmetics units an attractive appearance.

Figure 2:
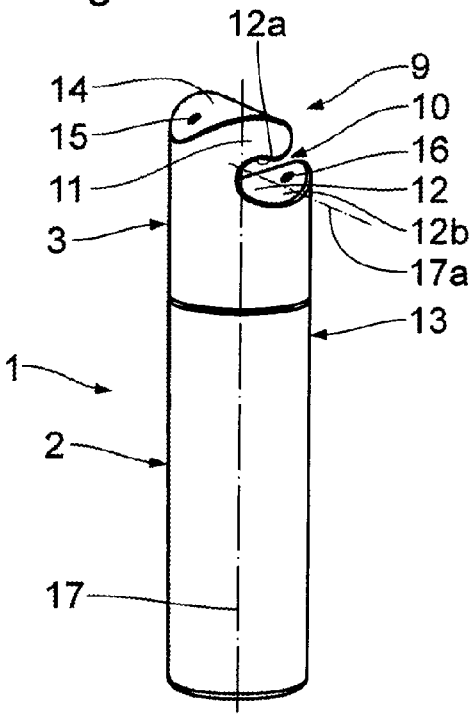
Figure 3:
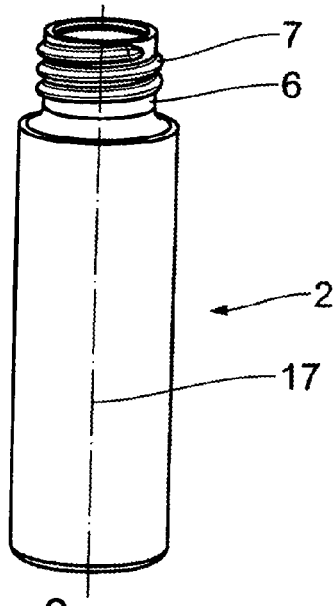
Figure 4:
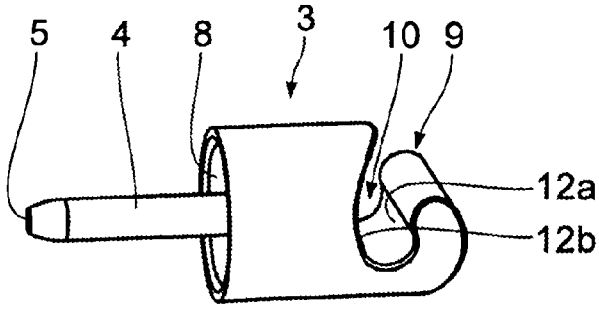
Figure 5:
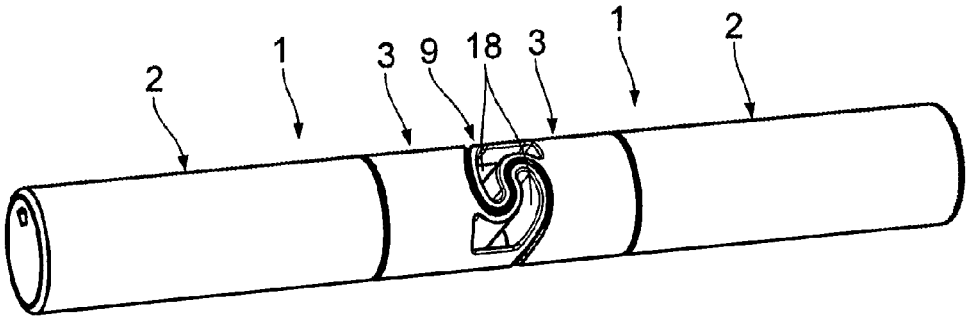
Figure 6:
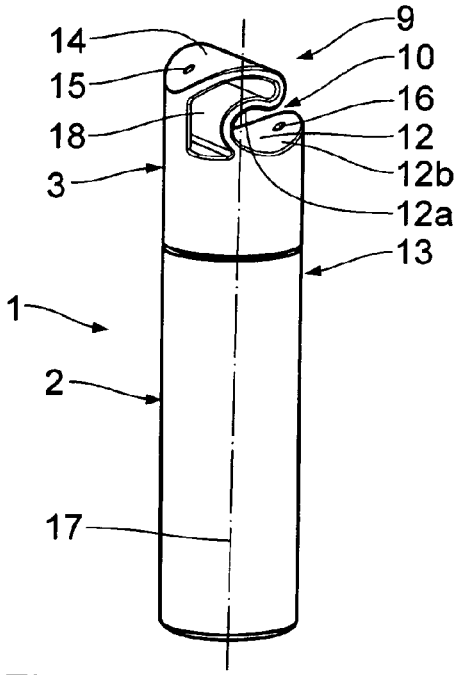
Figure 7:
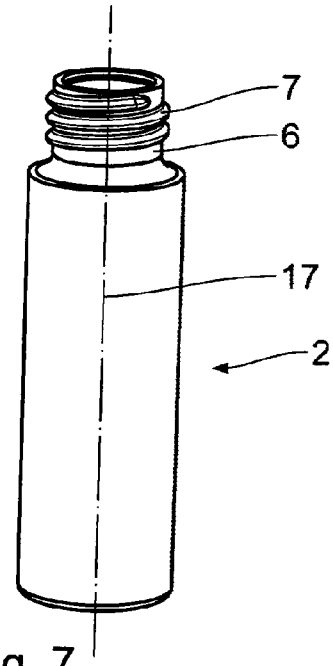
Figure 8:
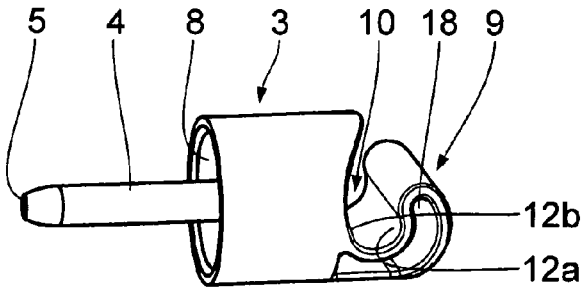

The invention will be explained in more detail with reference to preferred exemplary embodiments in conjunction with the drawing. In the figures:

FIG. 1: shows a perspective view of two cosmetics unit according to the invention coupled with each other, FIG. 2: shows a perspective view of a single standing cosmetics unit according to the invention, FIG. 3: shows a perspective view of the cosmetics unit with the cap removed, FIG. 4 shows a cap in the removed state, FIGS. 5 to 8: show a representation corresponding to FIGS. 1 to 4 of an embodiment with a hollow coupling device, FIGS. 9 to 12: show a representation corresponding to FIGS. 1 to 4 of an embodiment of a coupling device with a push-on sleeve, and FIGS. 13 to 17: show a representation corresponding to FIGS. 9 to 12 of another embodiment.

A cosmetics unit 1 shown in FIGS. 1 to 4 comprises a container 2 and a closure cap 3 on whose inside a stem 4 with an applicator 5 is attached, which is disposed on the front side and is not shown in completely in the drawing. The cosmetics unit 1 has a central longitudinal axis 17.

On its top side, the container 2 comprises a tapered neck 6 with an external thread 7 corresponding with an internal thread 8 on the inner wall of the closure cap 3, so that the closure cap 3 can be screwed onto the container 2.

A coupling device 9 which comprises a coupling recess 10 and a coupling projection 11 is formed on the free outer or top end of the closure cap 3, in particularly molded on integrally.

In this exemplary embodiment, the coupling recess 10 is formed approximately in the shape of an ellipse section, and its inner wall 12 extends, relative to an insertion direction 17*a* oriented perpendicularly to the central longitudinal axis 17, over a circumferential angle range of more than 180°. Starting from a jacket surface 13 of the cosmetics unit 1, the coupling recess 10 extends substantially perpendicularly to the central longitudinal axis 17 and to the insertion direction 17*a* into the base body of the cosmetics unit 1, in particular into its closure cap 3.

Because the inner wall 12 spans, relative to the insertion direction 17*a*, a circumferential angle range of more than 180°, the inner wall forms an upper and a lower undercut 12*a* and 12*b*, respectively, in the first exemplary embodiment shown in FIGS. 1 to 4, as well as in the slightly modified second exemplary embodiment shown in FIGS. 5 to 8.

The coupling projection 11 reaches over the coupling recess 10 at its top side and extends not quite to the jacket surface 13 of the cosmetics unit 1. Accordingly, the coupling projection 11 terminates the top side of the closure cap 3 in an arc shape, and has a curved surface 14 on which a latching projection 15 is formed, whereas the inner surface 12 of the coupling recess 10 comprises a corresponding point-shaped latching recess 16.

The inner surface 12 and the outer surface 14 of the coupling recess 10 or the coupling projection 11, respectively, extend at least partially perpendicularly to the central longitudinal axis 17 of the cosmetics unit 1.

Accordingly, it is possible to hold two cosmetics units 1 or their caps 3, respectively, next to each other in such a way that the coupling projection 11 of the one cosmetics unit 1 is aligned with the coupling recess 10 of the other cosmetics unit 1, and then to push the coupling projection 11 into the coupling recess 10 by means of a movement in the insertion direction 17*a*, and thus perpendicular to the central longitudinal axis 17, until the jacket surfaces 13 of the two cosmetics units 1 are aligned with each other, as shown in FIG. 1. In the process, the latching projection 15 on the coupling projection 11 latches into the latching recess 16 of the coupling recess 10, and the state shown in FIG. 1 is created, in which the two cosmetics units 1 are connected with each other so as to be axially and torsionally secured, thus, on the whole, stable as regards the final position, but detachable, and in which they also form a unit with regard to their appearance, namely a double cosmetics unit. The cosmetics units 1 thus connected with each other are, in particular, configured identically with regard to their construction.

For use, the one cosmetics unit 1 with the screw-on cap 3 connected therewith can be screwed off the container 2 of the respectively other cosmetics unit 1, so that an elongate handle is created which facilitates a very comfortable handling. Alternatively, however, it is also conceivable to uncouple a cosmetics unit 1 from the respectively other cosmetics unit 1 prior to its use, and to reestablish this connection following use.

The embodiment shown in FIGS. 5 to 8 for the most part matches the embodiment shown in FIGS. 1 to 4, and differs from it only by the coupling device 9 comprising a cavity 18 which can be designed to have an attractive appearance and which furthermore reduces the amount of plastic required for the coupling device 9, so that costs can be saved because of this, and because of a consequently shorter cycle time during the injection-molding process.

The embodiment according to FIGS. 9 to 12 is also very similar to the embodiment according to FIGS. 1 to 4, with, however, the coupling device 9 being connected with a push-on sleeve 19 that can be slipped onto the closure cap 3. Longitudinal ribs 20 are formed on the outside of the closure cap 3, and corresponding longitudinal ribs 21 are also provided in the inside of the push-on cap 19, so that the push-on sleeve 19 fits non-rotatably when pushed onto the closure cap 3.

Figure 9:
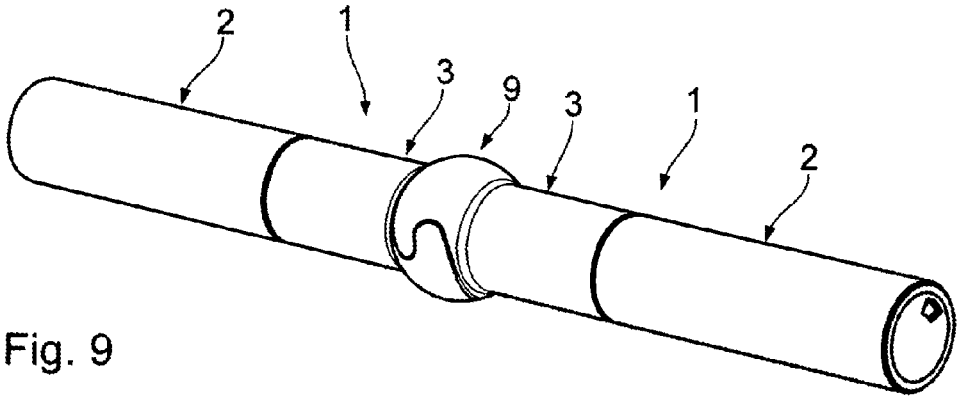
Figure 10:
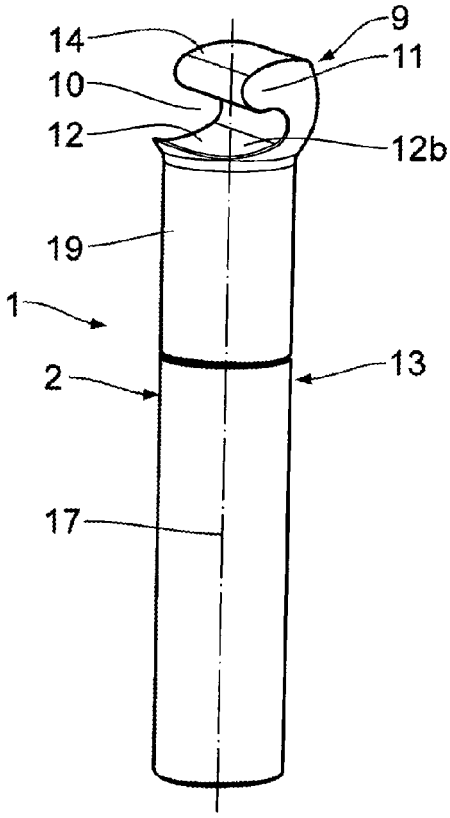
Figure 11:
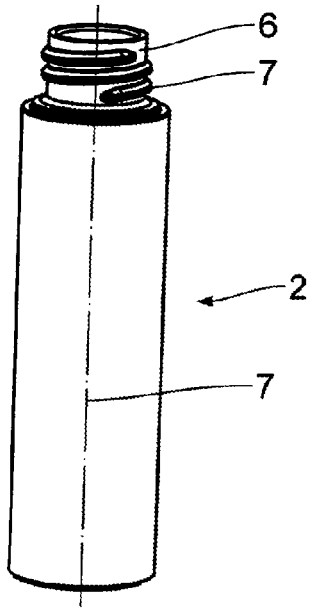

The coupling device 9 protrudes over the jacket surface 13 of the cosmetics unit 1, so that a central ball-like compacted portion, which can be seen in FIG. 9, is created in the coupled state.

At the outer lower axial end of the closure cap 19, a latching bead 22 is provided which latches into a latching groove 23 at the lower axial end of the closure cap 3 when slipped on completely onto the closure cap 3, so that an axial fixing, i.e. a fixing in the direction of the central longitudinal axis 17, is achieved thereby.

Another difference between the embodiment according to FIGS. 9 to 12 and that according to FIGS. 1 to 4 lies in the fact that only the lower undercut 12*b* is provided in the embodiment according to FIGS. 9 to 12.

The embodiment according to FIGS. 13 to 17 technically corresponds to the embodiments described above, with there being a difference merely with regard to the design in so far as the outer contour, as seen in cross section, is approximately square, and a coupling recess 10*a* and a coupling projection 11*a* have plane partial boundary surfaces which merge into each other via edges 24, 25, 26 and 27, 28, respectively. The coupling recess 10*a* and the coupling projection 11*a*, as seen in the direction perpendicular to the insertion direction 17*a*, each have an approximately L-shaped cross-sectional area. In the coupled state of two cosmetics units 1 thus configured shown in FIG. 13, the coupling recesses 10*a* and the coupling projections 11*a* of the two cosmetics unit 1 engage each other in a hook-like manner. The L-shape of the coupling recess 10*a* causes an upper undercut 12*c*, which, relative to the insertion direction 17*a*, has a rectangular or square cross-sectional area.

Figure 12:
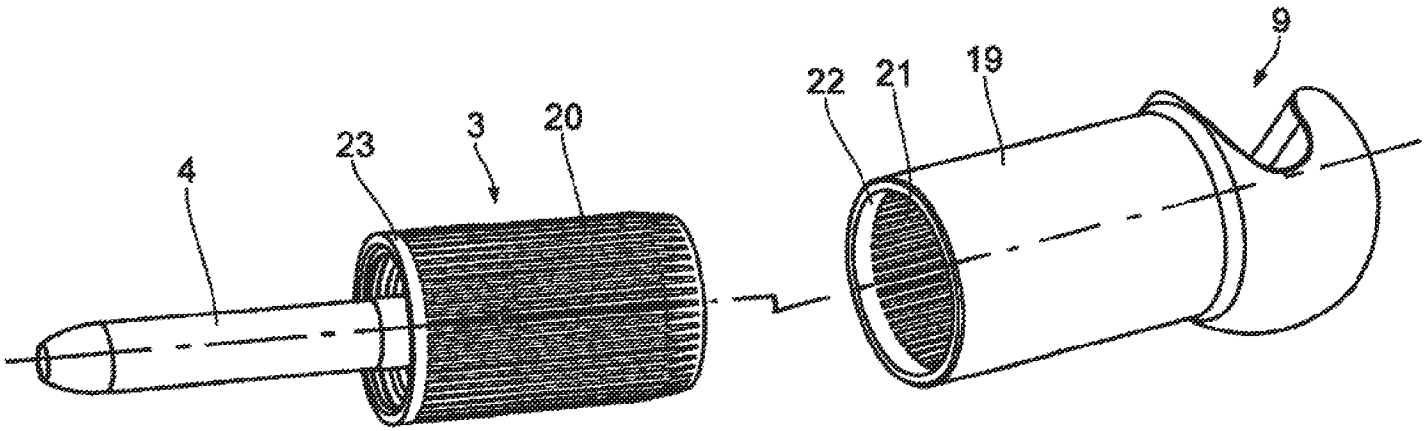
Figure 13:
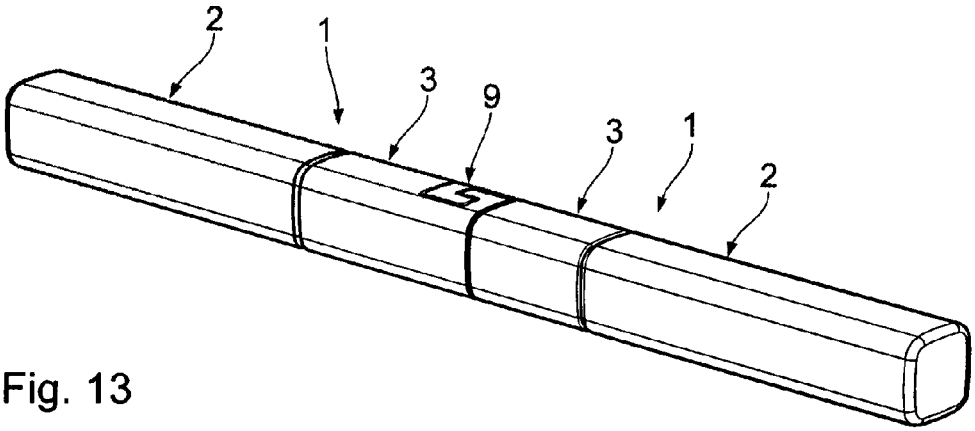
Figure 14:
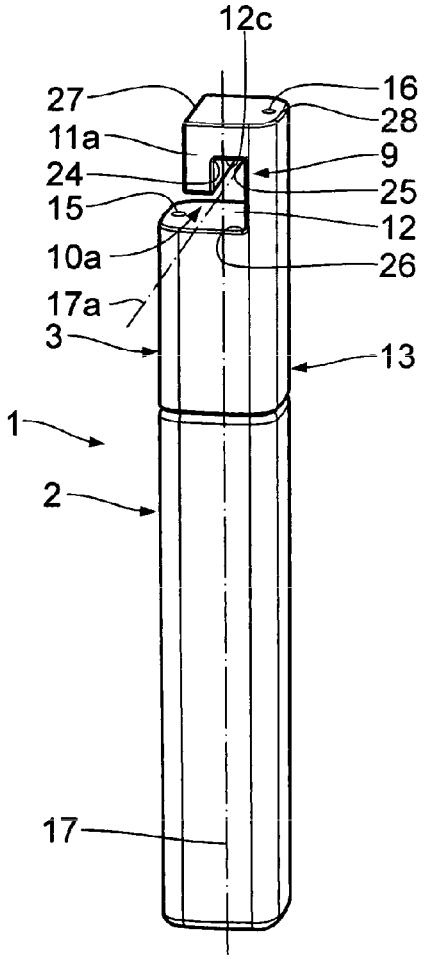
Figure 15:
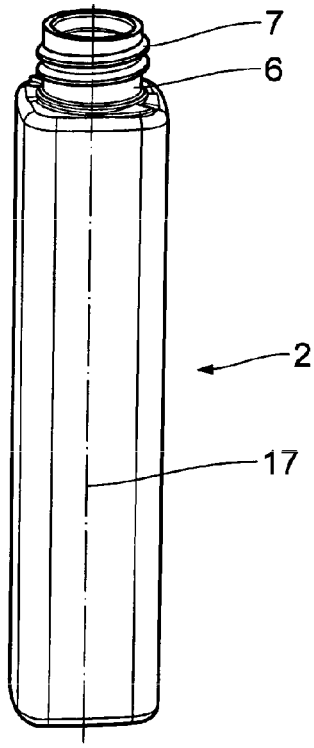
Figure 16:
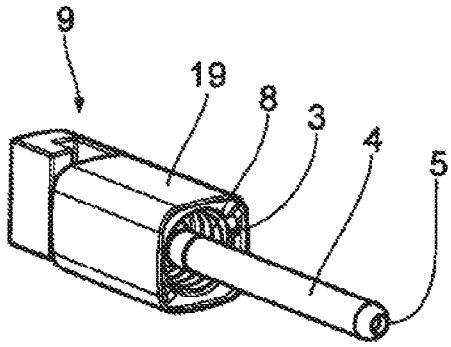
Figure 17:
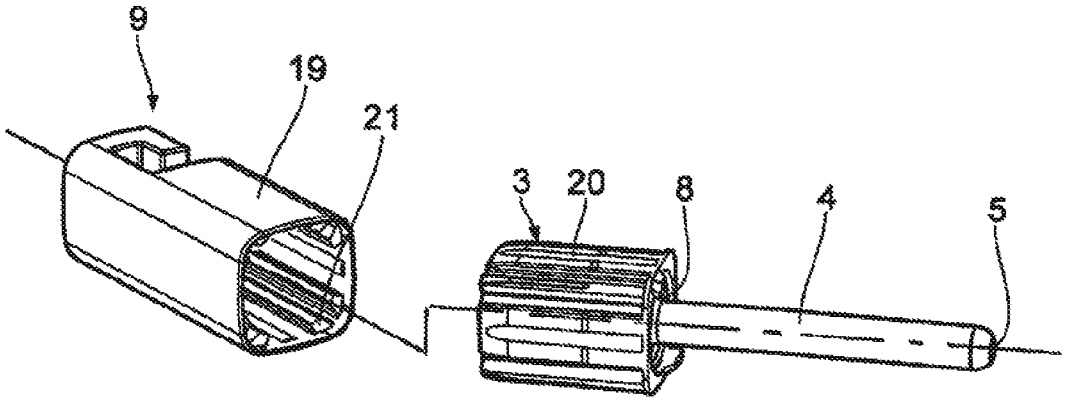

Moreover, the longitudinal ribs 20 of the closure cap 3 and the longitudinal ribs 21 of the push-on sleeve 19 are formed broader and thicker in this exemplary embodiment shown in FIG. 17 than in the exemplary embodiment shown in FIG. 12.

The invention claimed is:

1. Cosmetics unit comprising a container for receiving a cosmetic, a closure cap for the container, and an applicator, which is disposed on the closure cap, for applying the cosmetic, wherein two such cosmetics units can be connected with each other via a coupling device, wherein the cosmetics unit (1) has a coupling device (9) formed on the closure cap (3) for connection with a second cosmetics unit (1) comprising a corresponding coupling device (9), wherein the coupling device (9) has a coupling recess (10; 10*a*) extending perpendicularly to a central longitudinal axis (17) of the cosmetics unit (1), the coupling recess having an inner wall (12) spanning, relative to an insertion direction (17*a*) oriented perpendicularly to the central longitudinal axis (17), a circumferential angle range of more than 180° and thus forms at least one undercut (12*a*; 12*b*; 12*c*), and a coupling projection (11; 11*a*) formed to be complementary to the coupling recess (10; 10*a*), such that the coupling projection (11; 11*a*) of a first cosmetics unit (1) can be pushed into the coupling recess (10; 10*a*) of the second cosmetics unit (1) by means of a pushing motion in the insertion direction (17*a*) of the cosmetics units (1) to be connected, and wherein the coupling projection is received in the coupling recess in a positive fit in the pushed-in state.

2. Cosmetics unit according to claim 1, wherein the coupling recess (10) and the coupling projection (11) are formed in a rounded-off manner.

3. Cosmetics unit according to claim 1, wherein the coupling recess (10*a*) and the coupling projection (11*a*) have flat outer and inner walls, respectively, that merge into each other via edges (24, 25, 26, 27, 28).

4. Cosmetics unit according to claim 1, wherein the coupling projection (11) is formed to be at least partially hollow.

5. Cosmetics unit according to claim 1, wherein the coupling device (9) is disposed on a push-on sleeve (19) that can be slipped over the closure cap (3).

6. Cosmetics unit according to claim 5, further comprising longitudinal grooves (20, 21) for establishing a non-rotatable connection defined on the outside of the closure cap (3) and on the inside of the push-on sleeve (19).

7. Cosmetics unit according to claim 5, further comprising a latching groove and bead (23, 22), respectively, on the outside of the closure cap (3) and on the inside of the push-on sleeve (19), for establishing an axial fixing.

8. Cosmetics unit according to claim 1, further comprising a latching projection and a latching recess (15, 16), respectively, disposed on an outer surface (14) of the coupling projection (11; 11*a*) and the inner surface (12) of the coupling recess (10; 10*a*).

9. Cosmetics unit according to claim 1, wherein the coupling projection (11) protrudes radially outwardly over a jacket surface (13) of the cosmetics unit (1).

* * * * *